US007318395B2

(12) United States Patent
Huter et al.

(10) Patent No.: US 7,318,395 B2
(45) Date of Patent: Jan. 15, 2008

(54) INTERNAL COMBUSTION ENGINE HAVING A COOLANT CIRCUIT

(75) Inventors: Jurgen Huter, Weissach (DE); Bernhard Jutz, Gurgstetten (DE); Johannes Leweux, Esslingen (DE); Harald Pfeffinger, Tiefenbronn (DE); Heiko Sass, Tamm (DE); Timo Schmidt, Stuttgart (DE); Karsten Unger, Stuttgart (DE)

(73) Assignee: Daimler Chrysler AG, Stuttgart (DE)

( * ) Notice: Subject to any disclaimer, the term of this patent is extended or adjusted under 35 U.S.C. 154(b) by 0 days.

(21) Appl. No.: 11/205,770

(22) Filed: Aug. 17, 2005

(65) Prior Publication Data

US 2006/0011151 A1 Jan. 19, 2006

Related U.S. Application Data

(63) Continuation-in-part of application No. PCT/EP03/14375, filed on Dec. 17, 2003.

(30) Foreign Application Priority Data

Feb. 18, 2003 (DE) ..... 103 06 695

(51) Int. Cl.
*F01P 1/02* (2006.01)

(52) U.S. Cl. ..... 123/41.77; 123/41.72

(58) Field of Classification Search ..... 123/41.72, 123/41.76, 41.77

See application file for complete search history.

(56) References Cited

U.S. PATENT DOCUMENTS

| | | | | |
|---|---|---|---|---|
| 4,455,973 | A * | 6/1984 | Stadler et al. | 123/41.76 |
| 4,530,323 | A * | 7/1985 | Wakasa | 123/41.77 |
| 4,957,068 | A * | 9/1990 | Wagner et al. | 123/41.82 R |
| 5,537,969 | A * | 7/1996 | Hata et al. | 123/193.2 |
| 5,799,627 | A * | 9/1998 | Dohn et al. | 123/41.82 R |
| 6,418,886 | B1 * | 7/2002 | Haimerl et al. | 123/41.28 |
| 6,729,272 | B2 * | 5/2004 | Iizuka et al. | 123/41.84 |
| 7,044,089 | B2 * | 5/2006 | Yamada | 123/41.82 R |
| 2001/0023670 | A1 * | 9/2001 | Kuga et al. | 123/41.72 |
| 2003/0000487 | A1 * | 1/2003 | Schmitt | 123/41.72 |

FOREIGN PATENT DOCUMENTS

| | | |
|---|---|---|
| DE | 1 041 292 | 10/1958 |
| DE | 33 17 454 | 11/1984 |
| DE | 44 07 984.2 | 9/1995 |
| DE | 196 54 451 | 5/1998 |
| DE | 198 03 884 | 8/1999 |
| DE | 198 03 885 | 8/1999 |
| DE | 100 11 143 | 9/2001 |
| DE | 100 32 184 | 1/2002 |
| EP | 1 375 857 | 1/2004 |

* cited by examiner

*Primary Examiner*—Stephen K. Cronin
*Assistant Examiner*—Jason Benton
(74) *Attorney, Agent, or Firm*—Klaus J. Bach

(57) ABSTRACT

In an internal combustion engine having a coolant circuit which comprises a first coolant line for the cylinder block and a second coolant line for the cylinder head of the engine, with the cylinder head having at least one inlet valve and at least one outlet valve per cylinder, an additional coolant duct provided in the cylinder head in close proximity to the valves is connected to the second coolant line for directly supplying coolant to the area of the cylinder outlet valves.

4 Claims, 2 Drawing Sheets

INTERNAL COMBUSTION ENGINE HAVING A COOLANT CIRCUIT

This is a Continuation-In-Part Application of International Application PCT/EP2003/014375 filed Dec. 17, 2003 and claiming the priority of German Application 103 06 695.0 filed Feb. 18, 2003.

BACKGROUND OF THE INVENTION

The invention relates to an internal combustion engine having a coolant circuit comprising a first cooling line leading to a cylinder block and a second cooling line leading to the cylinder head.

German laid-open patent application DE 100 11 143 A1 discloses a liquid-cooled internal combustion engine with a dual-circuit cooling system in which a liquid-cooled cylinder block and a separate, liquid-cooled cylinder head are connected in a coolant-conducting fashion under the control of a valve as a function of temperature by means of openings in an intermediate cylinder head gasket. One or more of the valves, which control the coolant, are bimetal valves integrated into the cylinder head gasket.

German laid-open patent applications DE 33 17 454 A1, DE 198 03 884 A1 and DE 198 03 885 A1 also disclose liquid-cooled internal combustion engines with cooling circuits in which one cooling circuit is assigned to a cylinder head and one cooling circuit is assigned to a cylinder block. The cooling circuits are connected to one another. A connection to a heat exchanger is also provided. The cooling control circuits for the cylinder head and the cylinder block are closed-loop controlled independently of one another by means of valves and a corresponding control unit.

The object of the present invention is to provide an internal combustion engine having a cooling system or coolant circuit which operates in a selectively controllable fashion.

SUMMARY OF THE INVENTION

In an internal combustion engine having a coolant circuit which comprises a first coolant line for the cylinder block and a second coolant line for the cylinder head of the engine, with the cylinder head having at least one inlet valve and at least one outlet valve per cylinder, an additional coolant duct provided in the cylinder head in close proximity to the valves is connected to the second coolant line for directly supplying coolant to the area of the cylinder outlet valves.

The additional cooling duct is also referred to as a web cooling bore. This additional cooling duct is connected to the second cooling line which is assigned to the cylinder head.

The internal combustion engine according to the invention may be used as a drive motor in particular in a means of transportation, such as a motor vehicle.

By dividing the entire coolant stream between separate coolant lines for the cylinder head and cylinder block, a selective supply of coolant to the additional cooling duct in the cylinder head is provided. The additional cooling duct (the web cooling bore) in the cylinder head is preferably used to supply coolant exclusively via the separate cooling line for the cylinder head. Therefore, the adjacent components, specifically the highly loaded cylinder head in the combustion chamber region, can be cooled selectively in a controllable fashion. This leads to a reduction in fuel consumption and emissions of exhaust gases.

In a particular embodiment of the invention, an actuator element which controls the coolant inflow as a function of a temperature, in particular a coolant temperature, is associated with the first cooling line for the cylinder block. Dependency of the control on an internal combustion engine temperature, for example an engine oil temperature or a cylinder head temperature, is also conceivable. The actuation of the actuator element and the evaluation of the temperature values can be carried out by means of a control unit which is assigned to the internal combustion engine or to a motor vehicle with a corresponding internal combustion engine and/or by means of an additionally provided control unit. The actuator element and the control unit can be used to implement a heat management system with the objective of reaching an operating temperature of the internal combustion engine quickly and thus reducing the consumption of fuel and the emission of exhaust gases. In particular an active and/or passive switching element, for example a thermostat, can be used as the actuator element.

In a another embodiment of the invention, at least two outlet valves are provided per cylinder and the additional cooling duct is arranged in the cylinder head between these two outlet valves.

Since the region between the cylinder outlet valves are particularly subject to temperature loading, this embodiment leads to further improvement in the heat management and thus to a further reduction in fuel consumption and emissions.

Further advantageous embodiments of the invention will become apparent from the following description of exemplary embodiments described below with reference to the accompanying drawing:

DESCRIPTION OF PARTICULAR EMBODIMENTS

Figure 1:
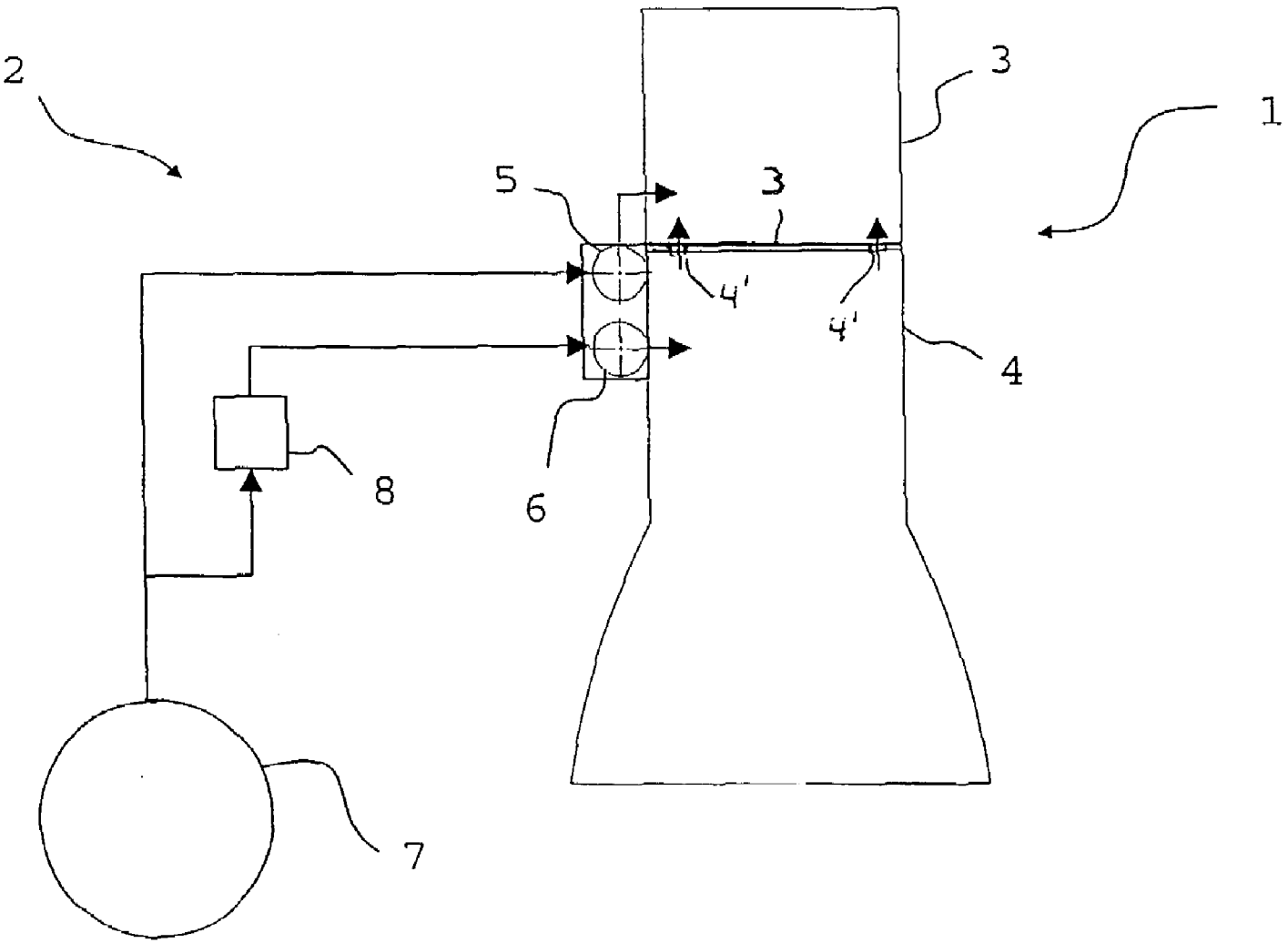
FIG. 1 shows schematically an internal combustion engine according to the invention with a coolant circuit.

In the drawings, functionally identical components are provided with the same reference symbols.

FIG. 1 shows an internal combustion engine 1 according to the invention with a coolant circuit 2. A pump 7 is arranged in the coolant circuit 2 and the coolant stream which is generated by the coolant pump 7 is distributed between a first coolant line 6 for a cylinder block 4, and a second coolant line 5 for a cylinder head 3. The coolant lines 5 and 6 can also be referred to as main ducts. The distribution is preferably carried out at the cylinder block 4. The coolant lines 5 and 6 can be integrated in the cylinder block 4 or they may be separate components.

Preferably at least one junction with the cylinder head 3 is associated with the second coolant line 5 and the second coolant line 5 is connected to an additional coolant passage (not illustrated) in the cylinder head 3 via said junction.

The first coolant line 6 is connected to the cylinder block 4 or to a water jacket of the cylinder block 4. A control element 8, which is assigned to the first coolant line 6, is provided in the coolant circuit 2. The supply of coolant to the first coolant line 6 is controlled by means of the control element 8 as a function of a coolant temperature. The control element 8 is a passive or active switching element, for example a thermostat. A control unit and/or evaluation unit (not illustrated), which is used in particular to evaluate a measured and/or estimated temperature signal and to actuate the control element 8, is associated with the control element 8.

The second coolant line 5, and thus the additional cooling duct in the cylinder head 3, are accordingly continuously supplied with coolant, while the cooling of the cylinder block 4 by way of the first coolant line 6 can be controlled as required by the control element 8. The coolant stream in the second coolant line 5 therefore forms a main coolant stream.

At least one junction (opening 4' in a gasket 3') with the cylinder head 3 is preferably also associated with the first coolant line 6, via which junction the cylinder head 3 can also be supplied with coolant from the coolant line 6. The coolant stream of the first coolant line 6 and the coolant stream of the second coolant line 5 can then be combined in the cylinder head 3.

The coolant streams or the respective directions of the coolant streams are indicated in FIG. 1 by straight arrows.

Figure 2:
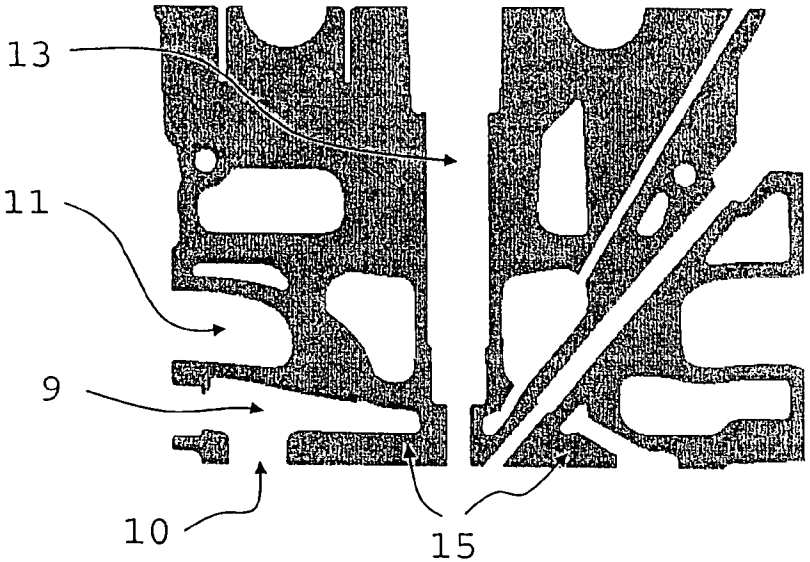
FIG. 2 shows a vertical section through a cylinder head with an additional cooling duct.
Figure 3:
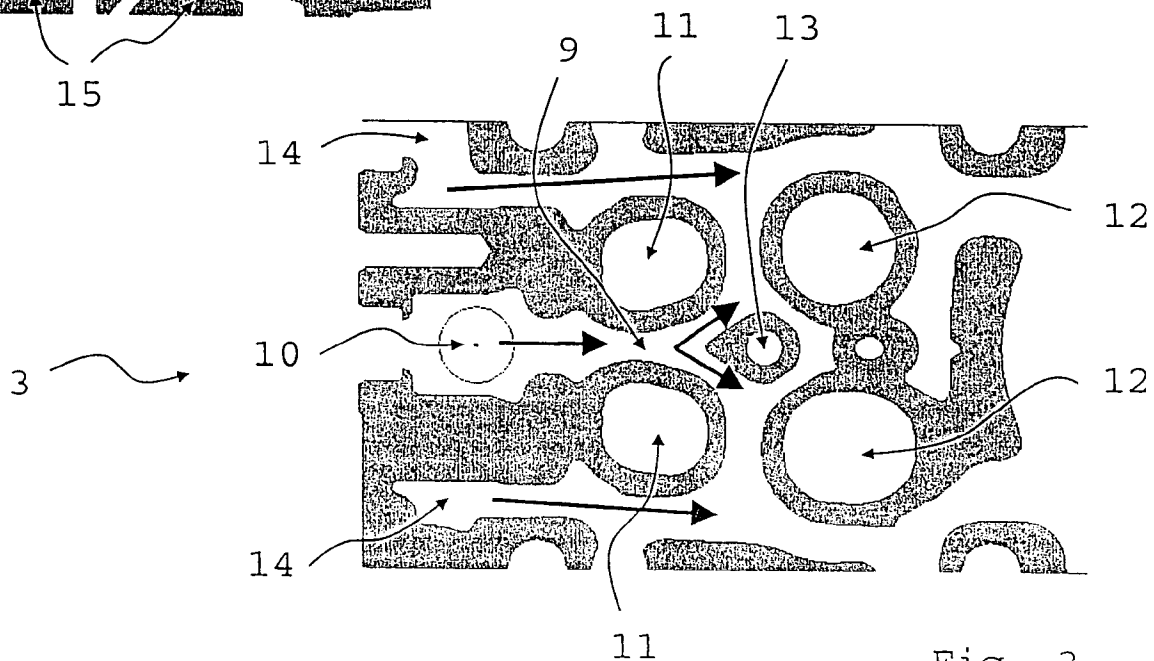
FIG. 3 shows a horizontal section through a cylinder head with an additional cooling duct.

A vertical section through a cylinder head 3 of an internal combustion engine according to the invention with an additional cooling duct 9 is illustrated in FIG. 2. A corresponding horizontal section of a cylinder head 3 with an additional cooling duct 9 is illustrated in FIG. 3. Directions of flow of the coolant are indicated in FIG. 3 by straight arrows. The coolant can pass from the second coolant line 5 (see FIG. 1) into the cooling duct 9 via at least one junction or overflow 10 from the cylinder block into the additional cooling duct or the web cooling duct 9.

The cylinder head 3 has, for example, two cylinder inlet valves and associated air inlet ducts 12 and two gas outlet valves and associated outlet ducts 11 for the exhaust gas. In the horizontal section in figure 3, the cooling duct 9 is preferably arranged between the outlet valves and the corresponding gas outlet ducts 11, the coolant stream preferably flowing in the direction toward the center of the combustion chamber or in the direction toward an injector or injection nozzle or a shaft 13 which is associated with it. It is also possible to provide a sparkplug (not illustrated) for a spark ignition engine. The region between the outlet ducts 11, the injector opening 13 and a cylinder base 15 is advantageously cooled or provided with coolant by means of the additional cooling duct 9.

Further junctions 14 between the cylinder block 4 and the cylinder head 3 may be provided and can be used to supply the rest of the cylinder head 3 with coolant. The direction of flow is preferably again in the direction of the center of the combustion chamber, as described above with respect to the additional cooling duct 9. The coolant streams which pass into the cylinder head 3 via the at least one junction 10 and the junctions 14 are combined again in the cylinder head 3.

A coolant overflow or coolant junction 14 of the water jacket of the cylinder block or of the first coolant line 6 (see FIG. 1) for the cylinder block is preferably provided via the openings 4' which have a defined cross-sectional area in a cylinder head gasket 3' A junction 10 from the cylinder block 4 or from the second coolant line 5 (see FIG. 1) for the cylinder head 3 is preferably also implemented as an opening with a defined cross-sectional area (not illustrated) in a cylinder head gasket 3'.

What is claimed is:

1. An internal combustion engine (1) including a cylinder block (4) and a cylinder head (3) and having a coolant circuit (2) comprising a first coolant line (6) extending to the cylinder block (4) and a second coolant line (5) leading to the cylinder head (3), the cylinder head (3) having at least one engine intake valve (12) and at least one engine exhaust valve (11) per cylinder, an additional cooling duct (9) arranged in the cylinder head (3) in close proximity to the engine valves (11, 12) and connected to the second coolant line (5), at least one junction (10) between the cylinder head (3) and the cylinder block (4) providing for communication between the cylinder block (4) and the additional cooling duct (9) via said junction (10), at least said one of junction (10) being on opening (4') in a cylinder head gasket (3') disposed between the cylinder block (4) and the cylinder head (3).

2. The internal combustion engine as claimed in claim 1, wherein at least one junction with the cylinder head (3) is associated with the first coolant line (6).

3. The internal combustion engine as claimed in claim 1, wherein at least two outlet valves are provided per cylinder, and the additional cooling duct (9) is arranged in the cylinder head (3) so as to extend between the two outlet valves.

4. The internal combustion engine as claimed in claim 1, wherein a control element (8) for controlling a coolant inflow as a function of a temperature is associated with the first coolant line (6).

* * * * *